US006505371B2

(12) United States Patent
Fischer et al.

(10) Patent No.: US 6,505,371 B2
(45) Date of Patent: Jan. 14, 2003

(54) SWEEPER

(75) Inventors: Franz Fischer, Leutenbach (DE); Martin Schmidgall, Aspach (DE)

(73) Assignee: Alfred Kaercher GmbH & Co., Winnenden (DE)

( * ) Notice: Subject to any disclaimer, the term of this patent is extended or adjusted under 35 U.S.C. 154(b) by 0 days.

(21) Appl. No.: 10/052,635

(22) Filed: Jan. 17, 2002

(65) Prior Publication Data

US 2002/0062530 A1 May 30, 2002

Related U.S. Application Data

(63) Continuation of application No. PCT/EP00/06782, filed on Jul. 15, 2000.

(30) Foreign Application Priority Data

Aug. 7, 1999 (DE) ..... 299 13 843 U

(51) Int. Cl.[7] ..... A46B 13/02; A47L 11/33
(52) U.S. Cl. ..... 15/41.1; 15/52.1; 15/83
(58) Field of Search ..... 15/41.1, 52.1, 15/83

(56) References Cited

U.S. PATENT DOCUMENTS

| | | | | | |
|---|---|---|---|---|---|
| 353,294 | A | * | 11/1886 | Drew | 15/41.1 |
| 376,028 | A | * | 1/1888 | Drew | 15/41.1 |
| 433,723 | A | * | 8/1890 | Eddy | 15/41.1 |
| 481,829 | A | * | 8/1892 | Sanford | 15/41.1 |
| 555,863 | A | * | 3/1896 | Hess | 15/41.1 |
| 688,189 | A | * | 12/1901 | Mason | 15/41.1 |
| 3,189,931 | A | * | 6/1965 | Peabody | 15/83 X |
| 3,892,003 | A | * | 7/1975 | Peabody | 15/52.1 |
| 4,207,641 | A | * | 6/1980 | Liebscher et al. | 15/41.1 |
| 4,701,969 | A | * | 10/1987 | Berfield et al. | 15/41.1 X |
| 4,709,436 | A | * | 12/1987 | Berfield et al. | 15/41.1 X |
| 5,319,819 | A | * | 6/1994 | Yoshizawa | 15/41.1 |

FOREIGN PATENT DOCUMENTS

| | | | |
|---|---|---|---|
| DE | 196 01 976 | | 7/1997 |
| GB | 744065 | * | 2/1956 |
| GB | 1114343 | | 5/1968 |
| GB | 1442587 | * | 7/1976 |
| GB | 2 134 777 | | 8/1984 |

* cited by examiner

*Primary Examiner*—Mark Spisich
(74) *Attorney, Agent, or Firm*—Barry R. Lipsitz; Douglas M. McAllister

(57) ABSTRACT

In order to construct a sweeper, which comprises a rotary brush arranged in a housing, a dirt collector which can be detachably attached to the housing and, adjacent the rotary brush in the dirt collector, a dirt inlet on the bottom edge of which a sill is arranged, in such a manner that the sill at the bottom edge of the dirt collector can be produced in particularly simple manner it is suggested that the sill be formed in one piece from a wall section which runs on one plane alongside both its longitudinal edges and which in between these edges stands out of this plane to one side, and that the wall section be connected to the bottom of the dirt collector alongside its longitudinal edges, whereby there will be a connection in two pieces at least alongside one longitudinal edge between the bottom and the wall section.

10 Claims, 3 Drawing Sheets

SWEEPER

This application is a continuation of international application No. PCT/EP00/06782 filed on Jul. 15, 2000.

BACKGROUND OF THE INVENTION

The invention relates to a sweeper comprising a rotary brush arranged in a housing, a dirt collector that can be detachably connected to the housing and, adjacent the rotary brush in the dirt collector, a dirt inlet on the bottom edge of which a sill is arranged.

For sweepers it is known that the dirt collectors are detached from the housing to be emptied and then transported to a place of discharge. These dirt collectors are usually open on one side, the open side constitutes the dirt inlet into the collector.

During the transport to the place of discharge there is the danger that the dirt collected in the dirt collector may fall out of the interior. To prevent this it is also known to provide for a sill at the bottom of the dirt collector in the region of the dirt inlet over which the dirt particles are whirled while the sweeper is in operation. A sill of this kind however prevents the dirt particles collected at the bottom of the dirt collector from falling out of the interior during the transport to the place of discharge.

Dirt collectors are often made in form of plastic containers, and for this reason it is difficult to form such sills integrally onto the bottom section, in particular problems to take out these parts arise during the production.

The object of the invention is to construct a sweeper in accordance with the preamble, in a way that the sill on the bottom edge of the dirt collector can be produced in a particularly simple manner.

SUMMARY OF THE INVENTION

For a sweeper of the kind described at the outset this object is accomplished in accordance with the invention by forming the sill out of a wall section that runs alongside both its longitudinal edges in one plane and stands out of this plane to one side in between these edges, and by connecting the wall section to the bottom of the dirt collector alongside its longitudinal edges whereby at least alongside one longitudinal edge between the floor and the wall section there is a connection consisting of two pieces.

A wall section standing out on one side is therefore formed, for example by means of an arch-shaped cross section or of a cross section with an offset angle, and this wall section is connected to the bottom of the dirt collector. For this the connection alongside both edges can consist of two pieces, which means that in the connecting area the wall section that is independent of the dirt collector and the bottom of the dirt collector are connected to each other, for example by snapping or sticking them together.

But it is also possible for such a connection consisting of two pieces to be made alongside one longitudinal edge only whereas alongside the other longitudinal edge there is a connection between the bottom and the wall section consisting of one piece. In this case the wall section is made in one piece with the bottom when the dirt collector is being formed, and by bending the wall section is then set in the position to the bottom in the way the sill is finally intended to be arranged. Normally this will be a tilting movement, this can be simplified particularly by designing the connection in one piece like a hinge connection, for example as a so-called film-hinge.

In this embodiment the free longitudinal edge is then connected to the bottom in a suitable way, whether by means of a mechanical snapping connection or by means of sticking or welding.

It is particularly advantageous for an embodiment to provide that the connection in two pieces of the bottom and the longitudinal edge of the wall section can be designed in a way that a projection snaps into a recess.

The recess can for example be designed as a longitudinal groove at the bottom into which the longitudinal edge of the wall section engages.

In this respect it is advantageous when the longitudinal groove is designed as a step in the bottom the upper edge of which stands out over the lower edge.

In particular the longitudinal groove can be designed as having a v-shape in the cross section.

Furthermore it is advantageous for the wall section to be designed in the shape of a wedge in cross section along its longitudinal edge engaging into the longitudinal groove, thereby the sliding in of the longitudinal edge into the longitudinal groove is facilitated.

A preferable embodiment provides for the connections of the longitudinal edges to the bottom to be so close to each other that the wall section is arched up elastically and the longitudinal edges are therefore submitted to a tension force drawing them apart. This ensures that a free edge of the wall section engaging into a longitudinal groove is held, it can only be drawn out of the groove against the elastic tension force that draws the longitudinal edges apart.

In particular the wall section can consist of two plane wall surfaces that are connected to each other at an angle, the connecting edge of the surfaces running parallel to the longitudinal edges of the wall section.

It is advantageous for the sill in the dirt collector connected to the housing to plunge into a corresponding recess of the housing, this leads to a particularly good fixation of the dirt collector to the housing and serves to assist the insertion. The corresponding recess in the housing can be designed as a sill or a ramp that is open on one side and v-shaped in cross section and is situated directly adjacent a rotary brush and that thereby serves as a guiding surface for the dirt particles whirled off from the rotary brush.

The following description of a preferred embodiment of the invention serves to explain it further with the help of the drawing.

DETAILED DESCRIPTION OF THE INVENTION

Figure 1:
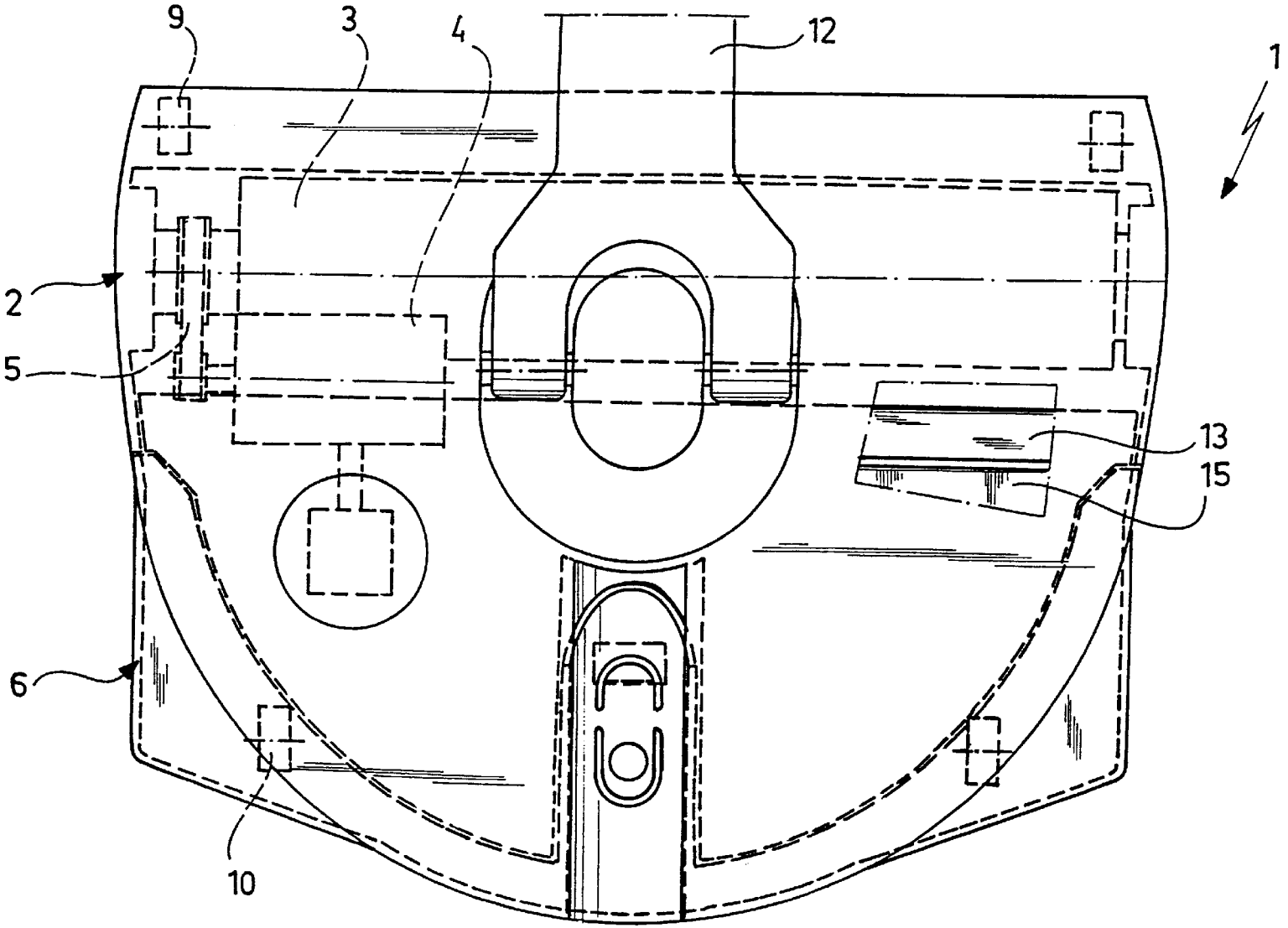
FIG. 1: shows a top view of a sweeper with a housing and a dirt collector attached to it.
Figure 2:
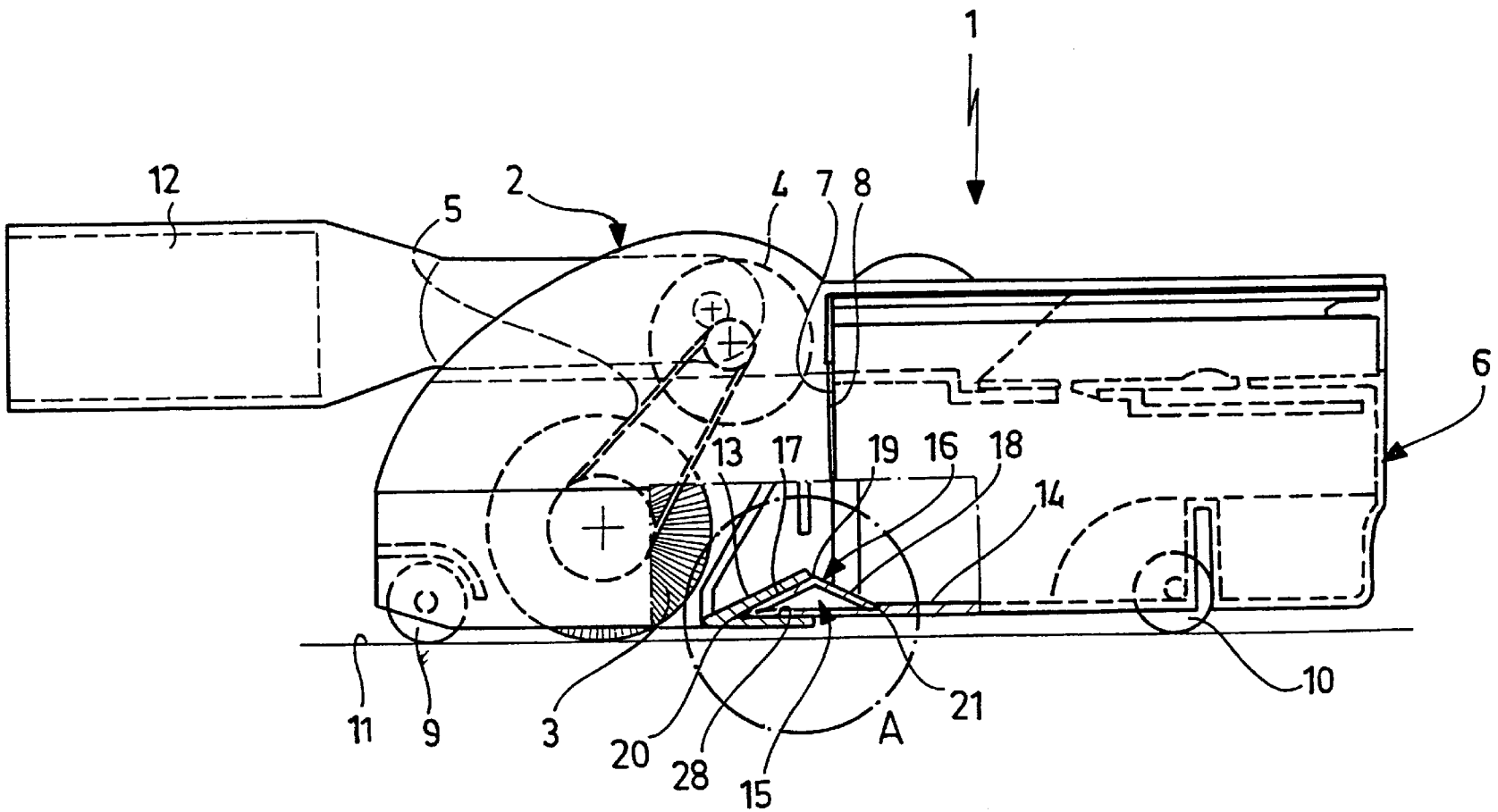
FIG. 2: shows a side view of the sweeper of FIG. 1 with a longitudinal section in the region of a sill connected to the dirt collector.

The sweeper 1 shown in the drawing comprises a housing 2 in which a rotary brush 3 is attached that can rotate and can be rotated by a drive 4 via a belt 5. The housing 2 is connected to a box-shaped dirt collector 6 that is open on the front side 7 facing the housing 2 and thereby forms an inlet for the dirt.

The open front side 7 has a connection to the front side 8 of the housing 2 which is also open and faces the dirt collector 6. In this region therefore there is a passage from the interior of the housing 2 to the interior of the dirt collector 6.

The housing 2 as well as the dirt collector 6 have rollers 9, 10 attached so that the sweeper 1 can be moved about on a surface to be cleaned 11, for example by means of a handle 12 that is attached to the upper surface of the housing 2 and is pivotable. In this process the rotary brush 3 that leaves the housing 2 at the bottom and lies close to the surface 11, and that is sent into rotation by the drive 4, sweeps away the dirt particles from the surface 11 and transports them into the interior of the housing 2.

Directly adjacent the rotary brush 3 in the housing 2 a rising ramp 13 is arranged that borders the open front side 8 of the housing at the bottom and that forms a guiding surface for the dirt particles whirled off from the rotary brush 3, these are whirled into the interior of the dirt collector 6 over the ramp 13.

At the bottom 14 of the dirt collector 6 there is a sill 15 that borders the open front side 7 at the bottom. The sill runs along the whole width of the dirt inlet of the dirt collector 6 and is formed by a wall section 16 with two plane wall surfaces 17, 18 that are connected at an obtuse angle with each other alongside an edge 19. Both the surfaces 17 and 18 end in longitudinal edges 20 and 21 respectively that run parallel to each other and to the edge 19 and that form a plane from which the wall surfaces stand out to one side.

The wall section 16 is connected in one piece along a longitudinal edge 20 to the bordering edge 22 of the bottom 14 and therefore is a prolongation of this bottom 14. The connection is designed in the manner of a film hinge which means that a flexible region is created in the transition between the bottom 14 on the one side and the wall section 16 on the other by a thinned-out part of the material 23.

Figure 3:
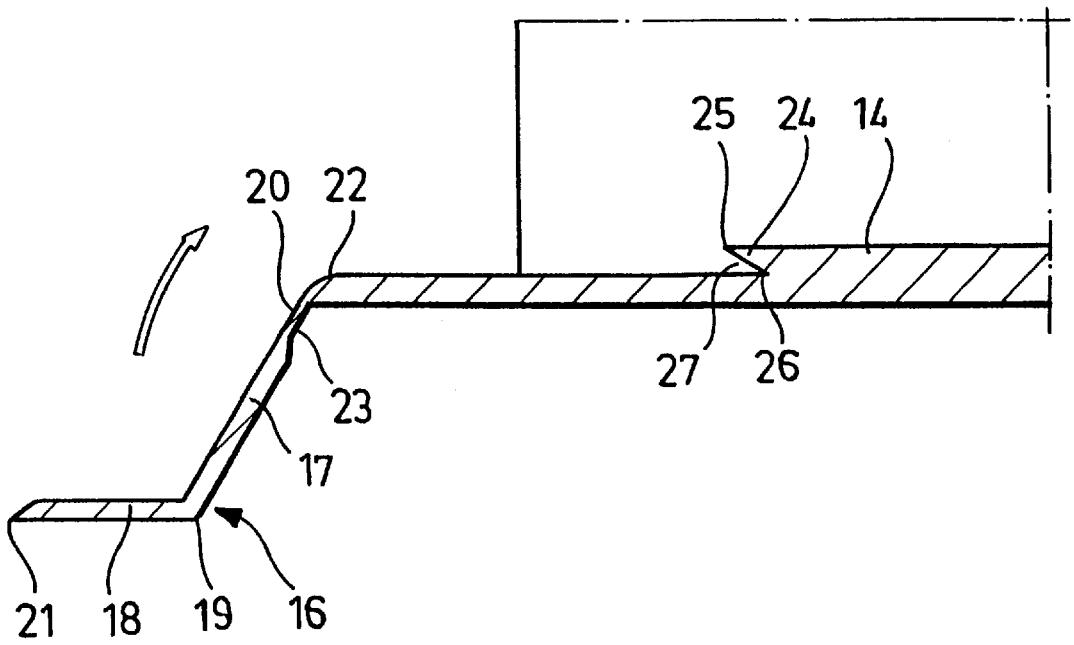
FIG. 3: shows an enlarged view of the details of the region A in FIG. 2 with a wall section connected to the bottom of the dirt collector before a sill has been formed
Figure 4:
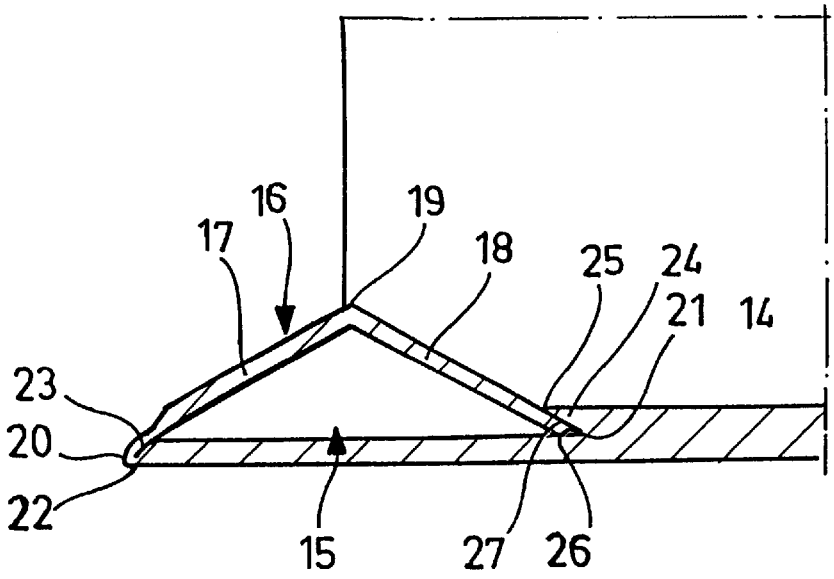
FIG. 4: shows a view similar to FIG. 3 after a sill has been formed.

The bottom 14 has a step 24 that is located at a distance to the bordering edge 22 and runs parallel to it. The upper edge 25 of this step stands out over the lower edge 26 so that thereby a longitudinal groove 27 is created that is v-shaped in cross section (FIG. 3).

The distances are chosen such that the longitudinal edge 21 engages into the groove 27 when the wall section 16 is tilted upwards around the bordering edge 22. During this process the engaging of the longitudinal edge 21 into the longitudinal groove 27 can be achieved solely by tilting the wall surfaces 17 and 18 of the wall section 16 elastically towards each other and by reducing the angle between the wall surfaces 17 and 18. In this way an elastic deformation of the wall section 16 occurs. As soon as the longitudinal edge enters the longitudinal groove the tension of the wall section 16 is released so that then the longitudinal edge 21 is held in tension in the longitudinal groove 27. The longitudinal edge 21 engages into the v-shaped longitudinal groove 27 particularly well when the wall surface 18 is pointed like a wedge in the region of the longitudinal edge 21, in this way basically corresponding to the cross section of the longitudinal groove 27.

This way the formation of a sill is achieved through the wall section 16 being integrally formed in one piece to the upper surface of the bottom 14 of the dirt collector 6, it suffices to tilt the integrally formed wall section 16 upwards and to insert the longitudinal edge 21 into the longitudinal groove 27.

In the dirt collector 6 connected to the housing 2 the sill 15 formed in this way plunges into a v-shaped recess 28 in the ramp 13 so that one can achieve an exact guiding of the dirt collector in relation to the housing 2, the sill 15 thereby practically becoming part of the ramp 13.

What is claimed is:

1. A sweeper, comprising:

a housing;

a rotary brush arranged in the housing;

a dirt collector detachably attached to the housing;

a dirt inlet arranged in the dirt collector adjacent the rotary brush; and a sill arranged on a bottom edge of the dirt inlet;

wherein:

the sill is formed out of a wall section having two longitudinal edges which run in one plane;

between said longitudinal edges, said wall section protrudes from said plane to one side;

the wall section is connected to a bottom of the dirt collector alongside said longitudinal edges;

a two-piece connection exists between the bottom and the wall section alongside one longitudinal edge; and the bottom and the wall section are connected to each other by a one piece hinge connection alongside the other longitudinal edge.

2. A sweeper in accordance with claim 1, wherein:

the wall section consists of two plane wall surfaces that are connected to each other at an angle; and a connecting edge of the wall surfaces runs parallel to the longitudinal edges.

3. A sweeper, comprising:

a housing;

a rotary brush arranged in the housing;

a dirt collector detachably attached to the housing;

a dirt inlet arranged in the dirt collector adjacent the rotary brush; and a sill arranged on a bottom edge of the dirt inlet; wherein:

the sill is formed out of a wall section having two longitudinal edges which run in one plane;

between said longitudinal edges, said wall section protrudes from said plane to one side;

the wall section is connected to the bottom of the dirt collector alongside said longitudinal edges;

a two-piece connection exists between the bottom and the wall section at least alongside one longitudinal edge; and said two-piece connection is formed by engaging a projection of one longitudinal edge into a corresponding recess in the bottom.

4. A sweeper in accordance with claim 3, wherein the recess is formed by a longitudinal groove in the bottom into which the longitudinal edge of the wall section engages.

5. A sweeper in accordance with claim 4, wherein:

the longitudinal groove is formed by a step in the bottom; and an upper edge of said step stands out over a lower edge of said step.

6. A sweeper in accordance with claim 5, wherein the longitudinal groove is V-shaped in cross-section.

7. A sweeper in accordance with claim 4, wherein the wall section is wedge-shaped in cross-section alongside its longitudinal edge which engages into the longitudinal groove.

8. A sweeper in accordance with claim 3, wherein the connections of the longitudinal edges to the bottom are located so closely to each other that the wall section is elastically arched out and therefore the longitudinal edges are submitted to a tension force drawing them apart.

9. A sweeper in accordance with claim 3, wherein:

the wall section consists of two plane wall surfaces that are connected to each other at an angle; and a connecting edge of the wall surfaces runs parallel to the longitudinal edges.

10. A sweeper, comprising:

a housing;

a rotary brush arranged in the housing;

a dirt collector detachably attached to the housing;

a dirt inlet arranged in the dirt collector adjacent the rotary brush; and a sill arranged on a bottom edge of the dirt inlet;

wherein:

the sill is formed out of a wall section having two longitudinal edges which run in one plane;

between said longitudinal edges, said wall section protrudes from said plane to one side;

the wall section is connected to the bottom of the dirt collector alongside said longitudinal edges;

a two-piece connection exists between the bottom and the wall section at least alongside one longitudinal edge; and the sill partially plunges into a corresponding recess of the housing.

* * * * *